US005566968A

United States Patent [19]

Challande et al.

[11] Patent Number: 5,566,968

[45] Date of Patent: Oct. 22, 1996

[54] ALPINE SKI BINDING ELEMENT EQUIPPED WITH A COMPENSATION DEVICE

[75] Inventors: Christian Challande, Cruseilles; Pierre Desarmaux, Evires; Pascal Thomas, Chambery, all of France

[73] Assignee: Salomon S.A., Metz-Tessy, France

[21] Appl. No.: 377,106

[22] Filed: Jan. 23, 1995

[30] Foreign Application Priority Data

Feb. 9, 1994 [FR] France ..... 94 01657

[51] Int. Cl.[6] ..... A63C 9/08

[52] U.S. Cl. ..... 280/634; 280/625; 280/636

[58] Field of Search ..... 280/628, 634, 280/636, 607, 625, 629

[56] References Cited

U.S. PATENT DOCUMENTS

| | | | |
|---|---|---|---|
| 4,538,828 | 9/1985 | Dimier | 280/628 |
| 4,902,031 | 2/1990 | Bogner | 280/636 X |
| 5,303,950 | 4/1994 | Rigal et al. | 280/636 |
| 5,344,180 | 9/1994 | Lancon et al. | 280/625 |

FOREIGN PATENT DOCUMENTS

| | | | |
|---|---|---|---|
| 0102868 | 3/1984 | European Pat. Off. | A63C 9/085 |
| 0580996 | 2/1994 | European Pat. Off. | A63C 9/085 |
| 2640516 | 6/1990 | France . | |
| 2640882 | 6/1990 | France . | |
| 2905837 | 8/1980 | Germany | A63C 9/085 |
| 3335878 | 4/1984 | Germany | A63C 9/085 |
| 4003536 | 8/1990 | Germany | A63C 9/085 |
| WO91/08808 | 6/1991 | WIPO | A63C 5/075 |
| WO91/09654 | 7/1991 | WIPO . | |

*Primary Examiner*—Kevin Hurley
*Assistant Examiner*—Michael Mar
*Attorney, Agent, or Firm*—Greenblum & Bernstein P.L.C.

[57] ABSTRACT

The invention relates to a ski binding element, in particular a front binding element. This element includes a jaw borne by a body, itself borne by a base. The jaw is mobile against the return force of the spring, and a compensation mechanism facilitates the opening of the jaw following an action exerted on a sensor. The sensor is a support element, or the mobile portion of a support element journalled about a longitudinal axis, the support element can only pivot on one side with respect to this axis, and is retained in abutment on the other side.

25 Claims, 4 Drawing Sheets

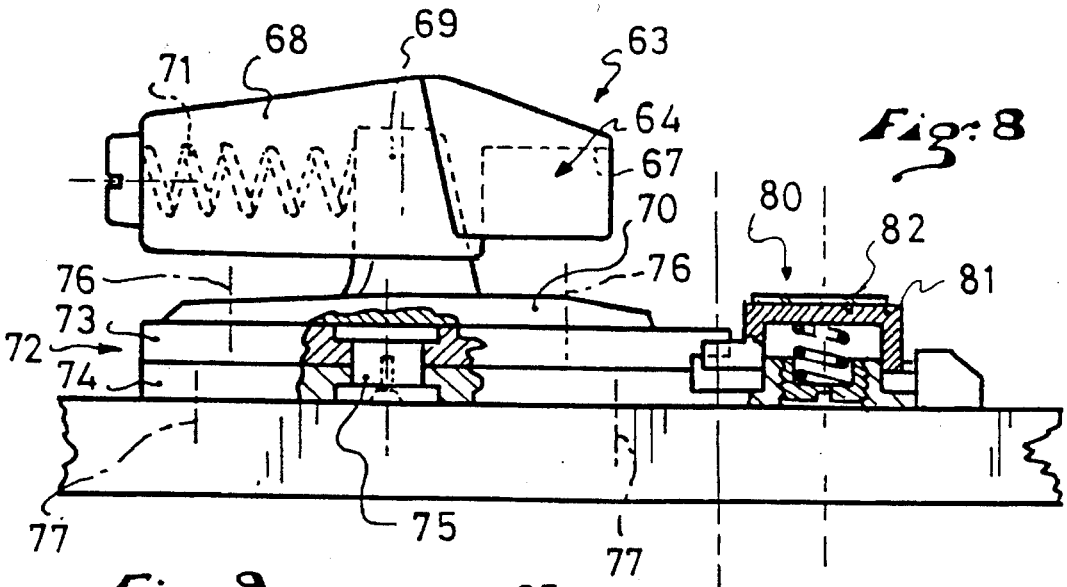
Fig: 8
Fig: 9
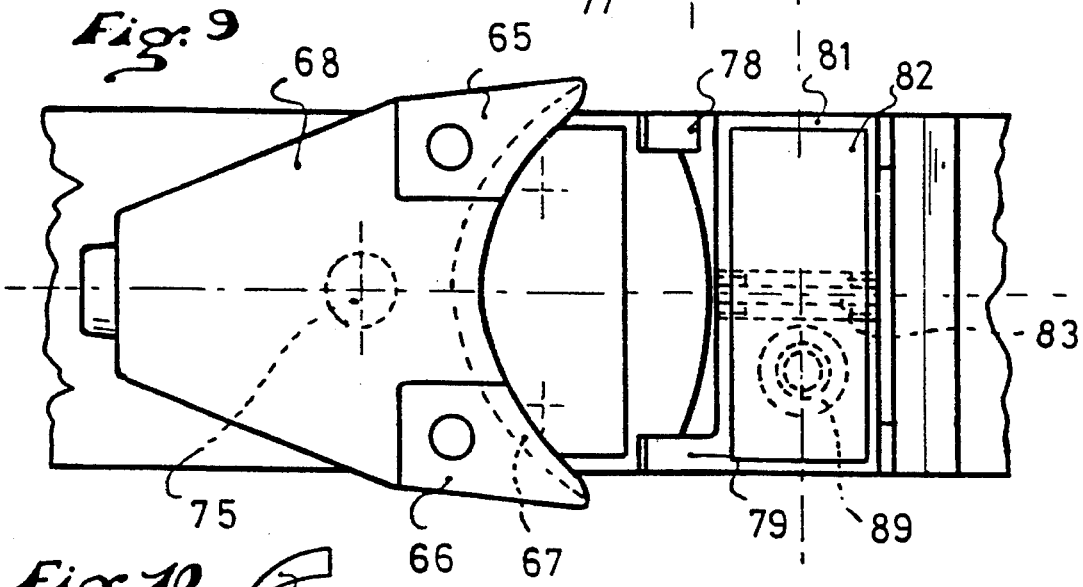
Fig: 10
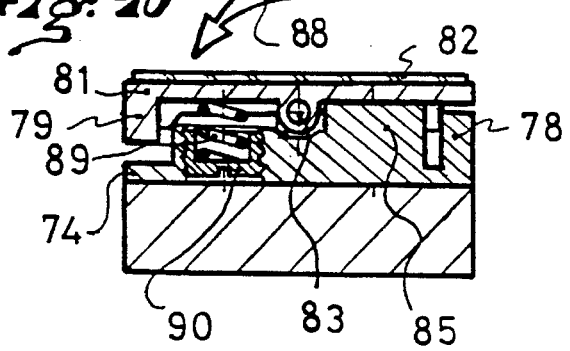
Fig: 11
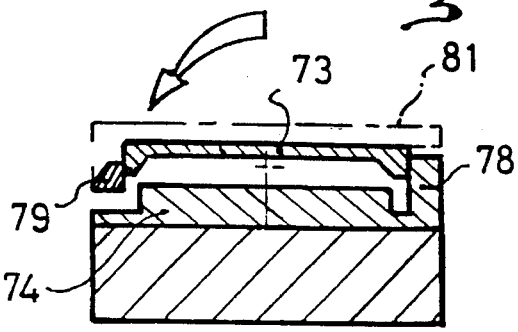

ALPINE SKI BINDING ELEMENT EQUIPPED WITH A COMPENSATION DEVICE

BACKGROUND OF THE INVENTION

1. Field of the Invention

The invention relates to an alpine ski binding element, intended to retain the boot in support on a ski, and to release it in case of excessive bias.

2. Discussion of Background and Material Information

Retaining a boot in support on a ski by means of a front binding element and a rear binding element is known. The primary function of these elements is to retain the boot on the ski in such a way as to enable the skier to guide his or her ski in particular by the efforts that the skier transmits to the boot as a function of the path that the skier wishes to follow and the reactions that the ski transmits to the skier. Another function of the binding elements is to relax this boot retention, i.e., to release the boot when the efforts between the boot and the ski become extreme to the point of causing injuries to the leg of the skier. It is difficult to discern at which point a bias becomes dangerous to the leg of the skier. Releasing the boot unnecessarily constitutes what has been designated an ill-timed release.

Each retention element usually has a jaw borne by a body, that is mobile against the return force exerted by an energy spring, generally a compression spring.

The present invention more particularly relates to a front binding element. Usually, the front binding element reacts to a lateral bias of the front end of the boot. Such a bias results from a pure torsional bias on the leg of the skier.

Certain binding elements also react to a vertical upward bias. One such bias corresponds to a rearward fall of the skier. European Patent Publication No. 102 868, for example, describes such a binding.

Other bindings have a compensation mechanism that reacts in the case of torsional bias combined with a forward fall of the skier. Such a mechanism is described for example in German Patent Publication No. 29 05 837. This mechanism comprises a boot support plate that is vertically mobile, whose movement caused by vertical downward pressure of the boot reduces the return force that the spring exerts on the law.

Another mechanism is described in German Patent Publication No. 33 35 878. This mechanism also comprises a boot support plate that is vertically mobile and that forces the jaw to be displaced in the direction of the boot release. Such devices compensate the increase in friction of the boot on its supports, that the forward component of the fall induces. Such mechanisms are satisfactory as long as the lateral component of the fall remains dominant with respect to the vertical component.

But, it happens that in the case of certain falls called "pre-torsion" i.e. with a forward component and a lateral component, the lateral component is not sufficient to cause the lateral rocking or pivoting of the jaw. One then experiences a twisting of the boot which becomes wedged between the jaw and its support plate. Currently known compensation mechanisms are not sufficiently active to cause the opening of the jaw. Sometimes falls are dangerous and cause injuries in particular in the area of the knees of the skier.

On this subject it has also been noted that the knee of the skier is more or less fragile according to the twisting or torque direction in which the leg is biased. Thus, it appeared important to seek improvement of the protection of the knee in particular in the torque direction where it is the most fragile.

SUMMARY OF THE INVENTION

Thus, one of the objects of the invention is to propose a binding element that releases the boot particularly in the case of a pre-torsion fall where the lateral component is relatively weak.

Another object of the invention is to facilitate this release only when the torsional bias of the leg of the skier occurs in a direction where the resistance of the knee is weaker, to retain the boot on the ski more firmly in the other bias direction.

Another object of the invention is to propose a binding element equipped with a sensor that is sensitive to such a bias on the knee.

Another object of the invention is to propose a binding element that is relatively simple to construct.

These objects and others that will appear in the description to follow are achieved by the binding element according to the present invention. This element has a jaw that is mobile against the return force of a spring, and a compensation mechanism that is adapted to reduce the return force that the spring opposes to the opening of the jaw by action of a bias captured by a sensor located beneath the boot. The sensor is comprised of a support element pivotally mounted about a substantially longitudinal direction. The sensor can pivot on one side between a substantially horizontal nominal position towards a slanted or inclined position on a side of the ski. Abutment means prevent the pivoting of the sensor on the other side, so that from this side, the sensor cannot exceed the nominal position.

Due to this construction of the sensor, the boot rests on a stable and precise support when it bears vertically on the ski or when it exerts a twisting bias on the binding element in the direction where the sensor cannot pivot. In the other twisting bias direction, the sensor activates the compensation circuit, which facilitates the release of the boot in the case of excessive bias.

According to another characteristic of the invention, the journal axis of the sensor can occupy different positions on the width of the sensor. This renders the sensor more or less sensitive to the bias of the boot.

According to another preferred characteristic of the invention, the compensation means only facilitate the release of the boot on the side where the sensor lowers in the direction of the ski. In particular, when the compensation means act by disengagement, for example, of the base of the binding element with respect to a base to which it is connected by a journal, the disengagement controlled by the compensation means only permits release rotation of the base on the side where the sensor lowers.

According to another characteristic of the invention, the support element can be made as a single pivotable piece or in two components, namely a fixed component and a mobile component that constitutes the sensor.

BRIEF DESCRIPTION OF THE DRAWINGS

The invention will be better understood in referring to the description below and to the annexed drawings that make up an integral part thereof, wherein:

FIG. 8 is a side elevation view of a binding element according to another non-limiting embodiment of the invention;

FIG. 9 is a top plan view of the binding element of FIG. 8;

FIG. 10 represents a transverse section of the support element of the binding element of FIG. 8;

FIG. 11 is a sectional view by a vertical and transverse plane at the level of the linkage between the support element and the base of the binding element.

DETAILED DESCRIPTION OF THE PREFERRED EMBODIMENTS

Figure 1:
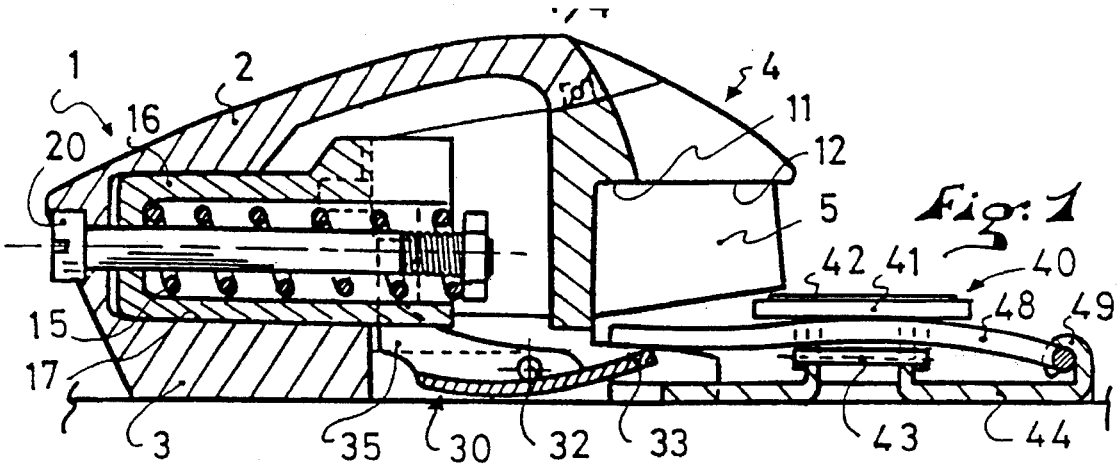
FIG. 1 is a partial sectional side elevation view of a binding element according to a first non-limiting embodiment of the invention.
Figure 2:
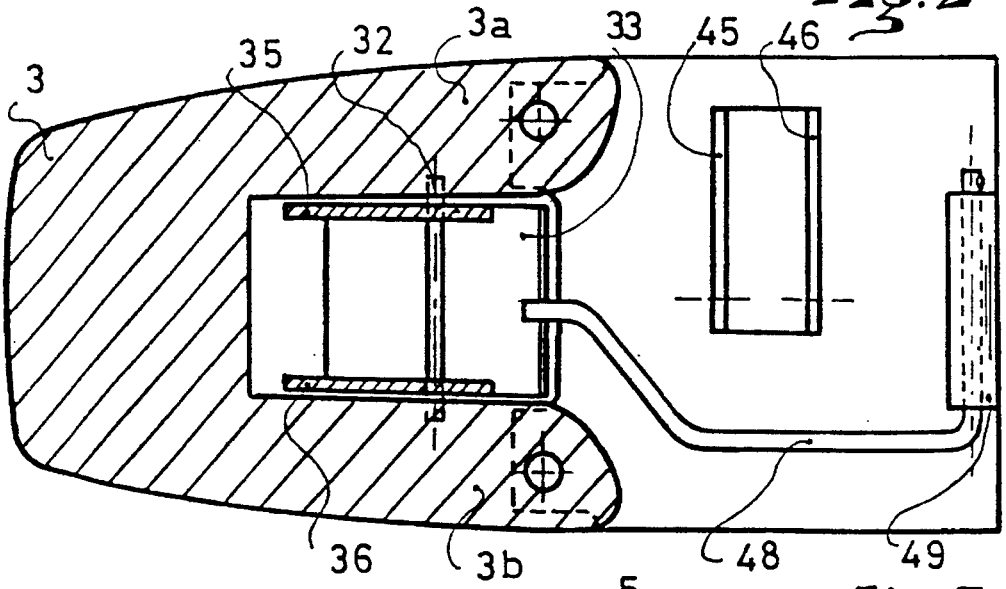
FIG. 2 is a top plan view, in partial section, of the binding element of FIG. 1 at the level of its base.
Figure 3:
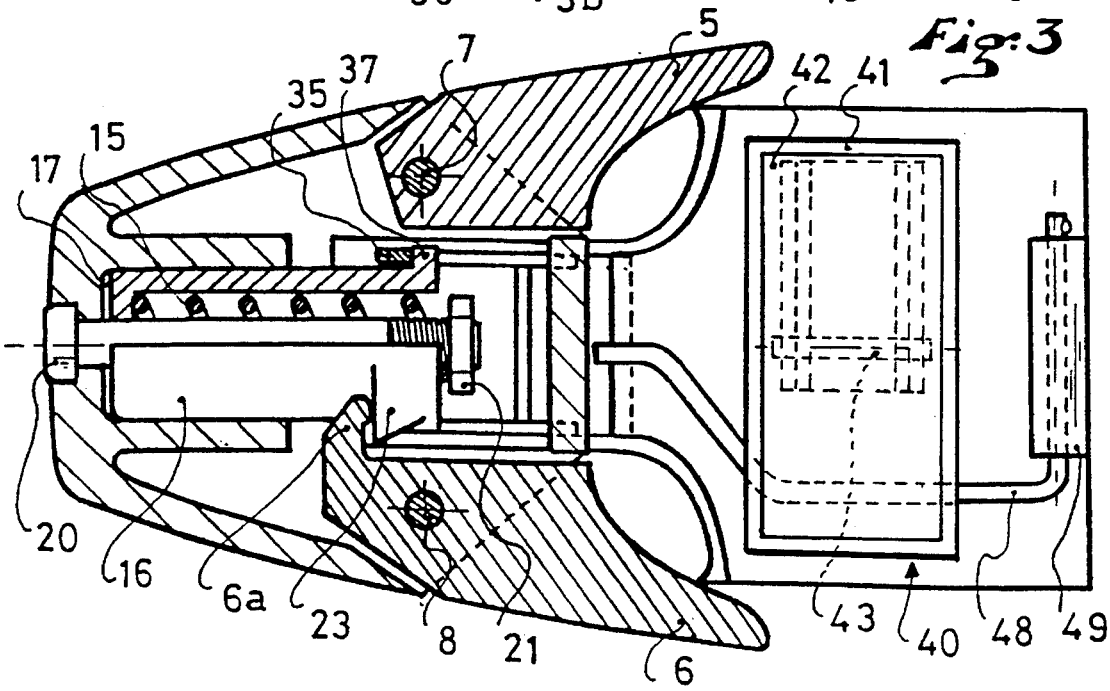
FIG. 3 is a top plan view of the binding element of FIG. 1, in partial section at a different cutting plane.
Figure 4:
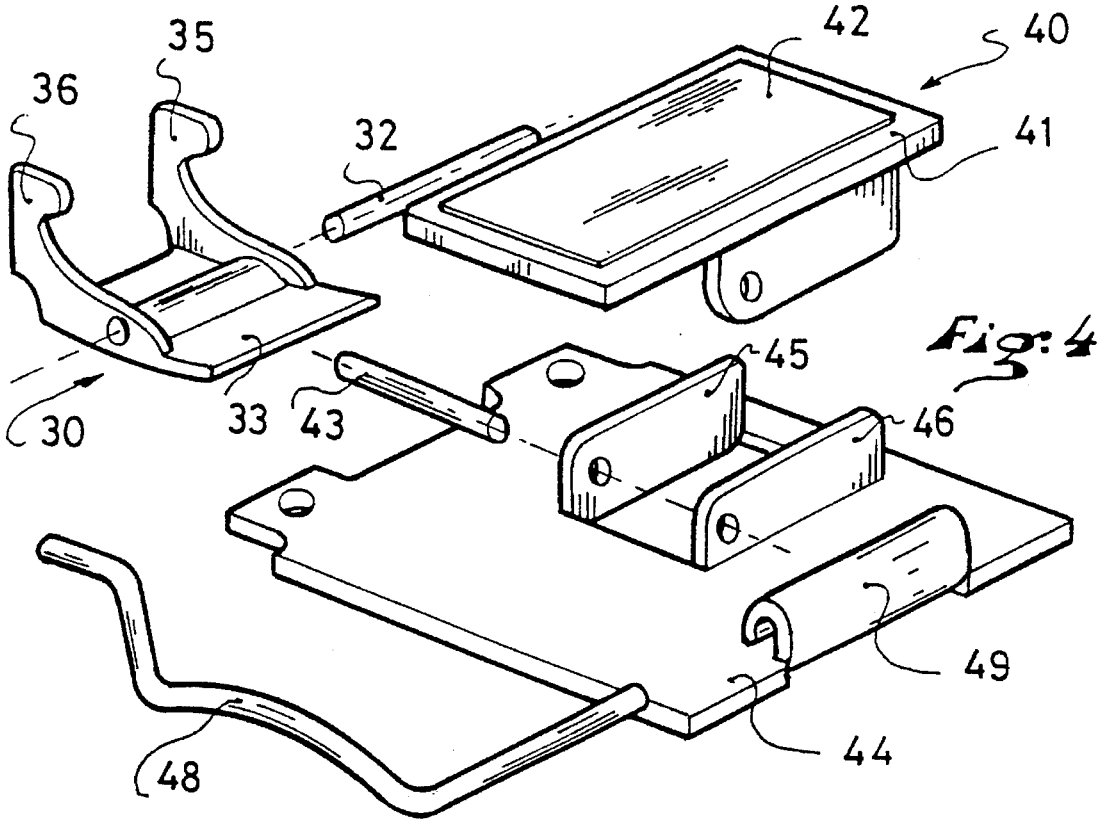
FIG. 4 is a perspective exploded view of the binding element of FIG. 1.

FIG. 1 illustrates a binding element 1 that, apart from the boot support device, has a generally known structure, such as that according to French Patent Application No. 2 640 516, for example. However, only the members of this binding essential for the understanding of the present invention have been represented.

In referring to FIG. 1, binding element 1 comprises a body 2 connected to a base 3 that is affixed to the ski by any appropriate means, such as, e.g., by screws. As seen from the top, the base has a "U" shape, open towards the rear, with two lateral arms 3*a* and 3*b*.

The body can be vertically mobile with respect to the base, for example, by a deformable linkage, but this is not essential for the invention.

The body 2 bears a retention jaw 4 for the front end of the boot. The jaw 4 comprises two lateral retention wings 5 and 6, respectively journalled to body 2 about vertical axes 7 and 8. The jaw 4 also comprises a sole-clamp 12 for vertical retention of the boot. The sole-clamp here has three parts respectively connected to the two wings and to a central pin 11 affixed to the body.

The wings 6 and 7 are mobile in response to the bias of the boot, against the return force that a spring 15 applies to them.

The spring 15 is housed in the body. It activates a piston 16 also housed and guided in the body for longitudinal translational movement. The figures show that the piston is housed and guided in a housing 17 of the body and that the spring is engaged inside of the piston. Its front end is in support against the bottom of the piston located on the front side of the binding element. A screw 20 whose head is retained by the front of the body, traverses additionally the piston and the spring, and has a nut 21 towards the rear that retains the rear end of the spring. A rotation of the screw drives the spring in translation, which enables adjustment of the initial compression of the spring.

Wings 5 and 6 have a small arm 5*a*, 6*a* beyond their journal axis to the body 7 and 8, that drives the piston 16 towards the rear by taking support against a shoulder 23 located in the upper rear portion of the piston 16.

Binding element 1 additionally comprises a support device 25 for the front end of the sole of the boot.

Element 1 has, in addition, a compensation mechanism that alleviates the return force that spring 15 exerts on the wings 5 and 6.

This mechanism comprises a rocking or pivoting device 30 that is housed in part between the arms 3*a* and 3*b* of base 3. The rocking device is journalled about an axis 32 borne by these arms.

The rocking device 30 has itself an approximately horizontal arm 33 that is accessible from the rear of the binding element, substantially beneath pin 11. The rocking device 30 has, in addition, an approximately vertical arm formed by two laterally spaced elements 35, 36, that are positioned on either side of the piston 16 and bear on a shoulder 37 of the piston which is beneath the shoulder 23 of the wings.

The rocking device has dimensions such that a vertical downward force exerted on its arm 33 is transmitted to piston 16 in the form of a rearward bias, i.e., in the same direction as the bias originating from the wings. The rearward displacement of piston 17 is accompanied by a rotation of the rocking device 30 about axis 32. The bias transmitted by the rocking device to the piston 17 proportionately decreases the force that one of the wings itself must exert on the piston in order to sufficiently displace it towards the rear so that the opening of the wing that results therefrom enables the release of the wing.

Naturally, other compensation mechanisms can exist.

Binding element 1 comprises, in addition, a support device 40 on which the sole of the boot rests.

This device comprises a transverse plate 41 that is located behind the jaw 4. Preferably, the plate 41 has at its surface a layer 42 of an anti-friction material, such as polytetrafluorethylene.

The plate 41 is mounted journalled with respect to an axle or pin 43 that is borne by a posterior extension 44 of the base 3. The axis 43 is oriented along a direction substantially parallel to the longitudinal and horizontal axis defined by the ski. The layer 42 is raised with respect to the extension 44 to enable rocking from a nominal position where the upper surface of the support plate is substantially horizontal.

According to the invention, this rocking can only take place in a single direction. In referring to FIGS. 1–4, ribs 45 and 46 rise from extension 44 towards the support plate, on the right portion of the journal axle 43. Advantageously, ribs 45 and 46 extend to journal axis 43 where they form the bearing of this axis.

Ribs 45 and 46 have a height that is sufficient to maintain the support plate 41 in its nominal position and to prevent it from rocking on this side of axle 43. It is possible that the support plate 41 also has on this side ribs that are located on its lower portion and that are engaged on the interior or exterior of ribs 45 and 46.

Support plate 41 can, however, freely rock or pivot on the other side in the direction of the ski, particularly in response to the twisting biases of the boot. It then acts as a sensor that is used to activate the compensation means.

To this end, a transmission means links the sensor and the rocking device of the compensation means. In FIGS. 1–4, the transmission means is a rod 48 generally oriented along a longitudinal direction. The rear end of the rod is bent along a transverse direction and enclosed by a fold 49 of extension 44, so as to enable a limited amplitude oscillation about this axis thus formed. From this end, rod 48 is bent and passes beneath the support plate 41, opposite ribs 45 and 46 with respect to axle 43, and at a relatively large distance from this axis. More towards the front, rod 48 is folded in such a manner that its front end bears on horizontal arm 33 of rocking device 30. Rod 48 is maintained raised with respect to extension 44 on its entire length, except in the area of its rear end. Preferably, the portion of the rod located beneath support plate 41 bulges slightly upward.

The rod acts as a lever and transmits to the rocking device 30 the bias induced by the rocking of the support plate 41 on the side opposite ribs 45 and 46.

Moreover, given its length, it is advantageously obtained in a material having a certain flexibility. The compensation effect is thus accompanied by a slight elastic shock absorption on the side where the plate 41 can rock.

The functioning of the device described hereinabove is as follows. When the boot exerts on the support plate 41 a vertical downward bias or bias with a component tending to make the support rock against ribs 45 and 46, i.e., on the right portion of the support plate, the support plate acts like a fixed plate solid with the ski. The transmission of the efforts between the ski and the boot is thus direct. Naturally, if the boot exerts a strong bias on the right wing, the latter will open and release the boot.

Conversely, if the boot exerts a bias tending to make the support plate rock in the other direction, it then leans on the rod 48 that transmits this bias to the rocking device and to the compensation means. The force that the boot must overcome to open the left wing is then decreased because of the compensation.

The binding element that is intended to retain the other foot has a symmetrical arrangement of the ribs and of the rod 48.

It is thought that such a device produces better results when the rod 48 is located towards the exterior of the foot and when the ribs 45 and 46 are located towards the inside of the foot.

The binding element can also have additional means to render the release of the boot on the side of the rod 48 even easier. For example, such as is visible in FIG. 3, the wing located on the side of rod 48, i.e., wing 6, can be shorter than the other, so that a smaller opening is required for the boot to be released. Another possibility consists of playing with the length of the small arms 5*a* and 6*a* of the wings, i.e., of making one arm shorter than the other.

Figure 5:
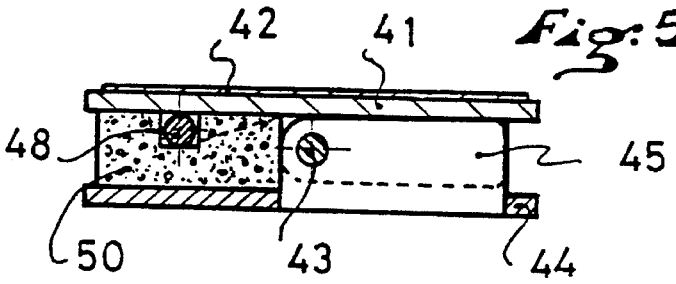
FIGS. 5–7 represent transverse sections of support elements according to different embodiments of the invention.
Figure 6:
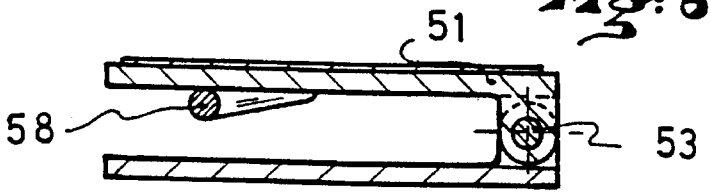
Figure 7:
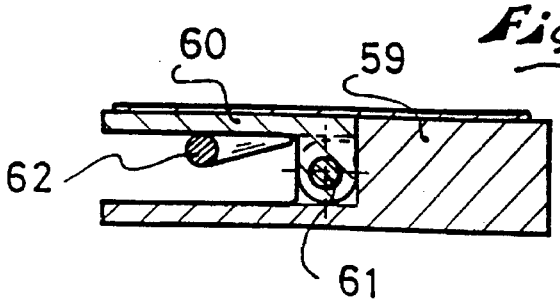

FIGS. 5–7 illustrate different embodiment variations. According to the variation of FIG. 5, the space between plate 41 and extension 44 on the left side of axis 43 is filled by a block 50 of elastically deformable material. This material prevents infiltrations of snow and dirt at this level. It can also contribute to the shock absorption of plate 41 when it rocks on the side of rod 48.

In the same way, the space between ribs 45 and 46 could be filled by an elastically extendible material that would be adhered at its upper surface and lower surface to the support plate 41 and to extension 44.

FIG. 6 illustrates an embodiment variation of the support device. According to this variation, support element 51 is journalled about an axis 53 located along one of the lateral edges. The rod 58 is located on the same side of axis 53 as in the preceding case.

The journal axis of the support element could also occupy positions other than the median position described in FIGS. 1–4, and the extreme position described in FIG. 6. The journal axis could also have a slightly offset orientation with respect to the longitudinal direction defined by the ski.

Also, the journal axis could be imaginary, i.e., formed by the cooperation of a particular form given to a portion of the support element with a corresponding form given to the extension.

FIG. 7 represents another embodiment variation of the support device. According to this variation, the boot rests on a support element that is in two portions along a transverse direction, one fixed portion 59 affixed to the extension or to the base of the binding, and a mobile portion 60 journalled about an axis 61 and in support against the transmission rod 62 that activates the compensation means. Only the mobile portion forms the sensor sensitive to the twisting biases of the boot. As was previously mentioned, journal axis 61 is not necessarily in a median position, but can also be located on one side or the other of this median position.

FIGS. 8–12 are relative to an embodiment variation where the compensation means of the binding element act by disengaging an element that finally leads to a free rotation of the jaw and to a forced release of the boot.

FIG. 8 represents a front binding element 63, that is of a known type.

The binding element is of any appropriate type, and its construction is not limiting for the embodiment illustrated in FIGS. 9–12. The element represented is a type of construction that is essentially described in French Patent Publication No. 2 640 882.

Element 63 has a retention jaw 64 for the front of the boot.

In a known manner, the jaw comprises two wings 65 and 66 for lateral retention of the boot. It additionally comprises a sole-clamp 67 for vertical retention. In the example illustrated, the sole-clamp has two parts that are respectively associated with each of the lateral retention wings. The jaw is borne by a body 68.

In the example illustrated, the jaw and the body are a single piece. They are pivotally mounted about a pivot shown by 69, that is affixed to a base 70. The body and the jaw can pivot at least laterally about a pivot 69 against the elastic return force opposed by a spring 71 that is housed in the body 68.

With reference to FIG. 8, the base 70 is connected to the ski by means of a structure 72. The structure 72 is represented in two superimposed portions, namely, an upper plate 73 and a lower base 74, that are assembled to each other by a pivot 75 with a vertical axis. The lower base and the upper plate can freely pivot with respect to one another, about this pivot.

Base 70 of the binding element is fixedly assembled to the upper plate 73, by any appropriate means, for example, by screws shown by the dotted-and-dashed lines 76.

The lower base 74 is itself fixedly assembled to the ski, in the mounting zone provided for the front binding element, by any appropriate means, for example, by screws shown by the dotted-and-dashed lines 77.

The upper plate 73 is retained in the axis of lower base 74, i.e., aligned on the longitudinal axis of the ski by two lateral stoppers 78 and 79 that confine the rear portion of the upper plate 73.

In the embodiment illustrated, stopper 78 is nonremovable. For example, it is affixed to base 74. The other stopper 79 is removable.

If stopper 79 releases the upper plate, then the plate can pivot by action of a very weak lateral bias, driving the body and the jaw along with it.

Binding element 63 additionally has a support device 80 for the boot. This device has a support element 81 of a general rectangular form, on which the sole of the boot rests. The support element is located behind the jaw 64, just behind the upper plate 73. The support element preferably has an anti-friction plate 82 at its upper surface.

The support element 81 is journalled in rotation about a longitudinal axis 83. Axis 83 is borne by an element fixed on the ski, for example, the rear extension of the lower base 74.

From its nominal position where its upper surface is substantially horizontal, the support element 81 can rock about axis 83 only on one side. Means prevent its rocking on the other side. In addition, on the side where it can rock, the support element controls the disengagement latch of the upper plate.

According to the embodiment illustrated, support element 81 rests on one side of axis 83 on a pin 85 that wedges it in its nominal position for any bias exerted on this side of the axis. For example, pin 85 and the rear portion of the lower base 74 are a single piece.

On the other side of axis 83, there is an empty space between the support element 81 and the lower base that permits rocking of the support element in the direction shown by arrow 88. Possibly, a means such as spring 89 resists the rocking of the support element and elastically returns it to its nominal position where it is in abutment against member 85. FIG. 10 also represents a threaded plug 90 that enables adjustment of the initial compression of the spring.

The removable stopper 79 that latches the upper plate 73 is affixed to the lateral edge of the support element 81. Thus, the rocking of the plate 81 causes the lowering of the stopper 79. The height of the stopper 79 is provided to release the plate 73 beyond a predetermined path.

Figure 12:
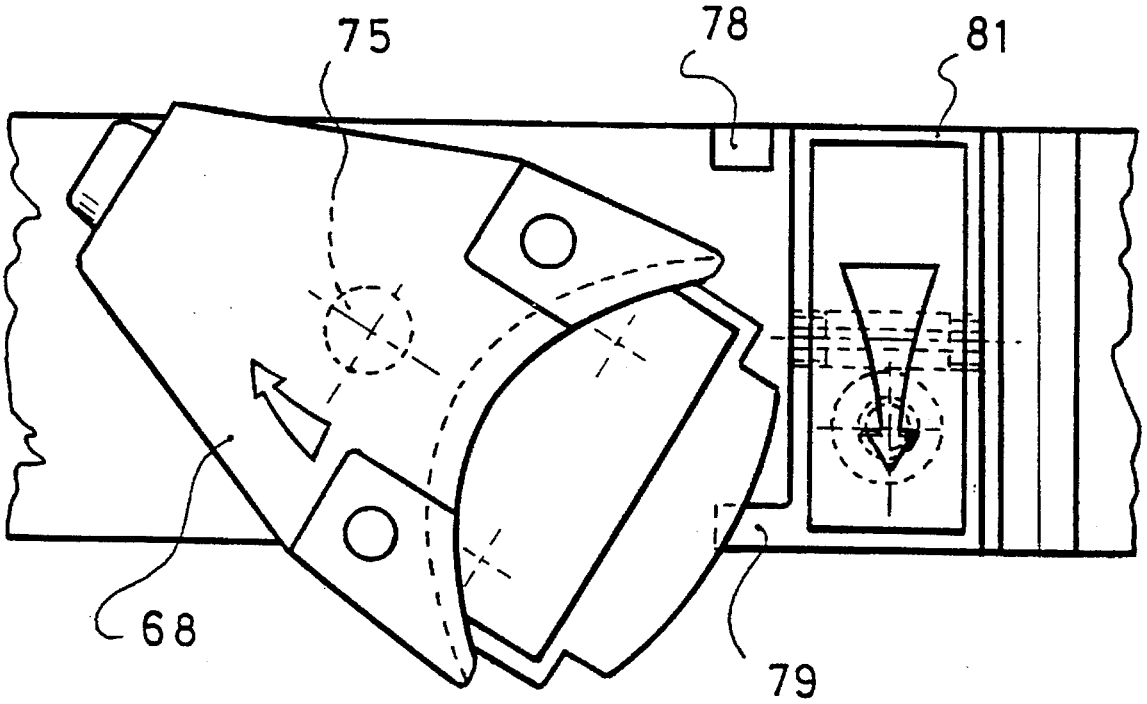
FIG. 12 is a top plan view that illustrates the functioning of the binding element of FIG. 8.

The upper plate is then released on the side where the support element 81 lowers in the direction of the ski. This is illustrated in FIG. 12.

The functioning of the device described hereinabove is as follows. In the case of bias exerted by the boot, which tends to maintain the support element in a nominal position or in support against member 85, the support element 81 acts as a plate affixed to the ski. The boot is retained by the jaw, and it is released following the rotation of the jaw and the body against the elastic return force of the spring 71.

If the bias exerted by the boot on the support element passes on the other side of axis 83, the plate functions as a sensor and rocks against the return force of spring 89. If the rocking amplitude is sufficient, stopper 79 releases the upper plate 73 which is then driven in rotation about pivot 75 by action of a very weak force. The boot is then released.

The variations described for the first embodiment also apply to the present embodiment.

Moreover, for the two principle embodiments described, the invention is not limited to the described constructions. For the case where the compensation means obtain an alleviation of the return force exerted by the return spring, the invention applies to other methods of construction of the binding element, as well as to other constructions of the compensation means. In the same way, for the case where the compensation means obtain a disengagement, the invention applies to other methods of construction of the binding element, as well as to different locations of this unlatching. For example, the unlatching could take place between the body and the base, or between the jaw and the body.

Also, the compensation means could produce in a combined manner an alleviation, then an unlatching for a strong rocking amplitude of the plate.

The means that guide the rocking of the plate are non-limiting.

The journal axis could indeed be replaced by any appropriate means.

In the same way, in the case where the compensation means act by disengagement, the removable latch that determines this disengagement is non-limiting.

The instant application is based upon French patent application 94.01657 of Feb. 9, 1994, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. A binding for retaining a boot on an alpine ski, said binding comprising:

a base for attachment to a ski;

a body mounted on said base;

a retention jaw borne by said body, said retention jaw comprising two lateral retention wings for laterally retaining the boot, at least one of said lateral retention wings being mounted for a horizontal component of movement during a boot release movement;

a spring housed in said body for elastically opposing release movements of said jaw in response to forces transmitted by the boot;

a compensation mechanism that reduces a return force exerted by said spring on at least one of said lateral retention wings in response to a force exerted by the boot;

a support device comprising a support plate for supporting at least an end of a sole of the boot, said support plate having a support surface for the boot that is substantially horizontal in a nominal position of said support plate;

a sensor formed by at least one lateral end portion of said support plate operatively associated with said compensation mechanism for activating said compensation mechanism to reduce said return force exerted by said spring;

an arrangement for mounting said support plate for pivotal movement about a substantially longitudinal fixed axis relative to the ski in a predetermined direction from said nominal position to an inclined position having said one lateral end portion of said support plate lowered toward the ski, and for blocking an opposite lateral end portion of said support plate against movement from said nominal position in a direction opposite to said predetermined direction.

2. A ski binding according to claim 1, wherein:

an elastic return element is located beneath said one lateral end portion of said support plate for resisting said pivotal movement in said predetermined direction and for returning said support plate to said nominal position.

3. A ski binding according to claim 1, wherein:

a block of elastically deformable material is located beneath said one lateral end portion of said support plate for resisting said pivotal movement in said predetermined direction.

4. A ski binding according to claim 1, wherein:

a curved rod is located beneath said one lateral end portion of said support plate, said one lateral end portion of said support plate being supported by a median portion of said curved rod, said curved rod having a pair of ends, one of said ends is supported at a fixed abutment; and said compensation mechanism comprises a movable element for transmitting a force exerted by said one lateral end portion of said support plate by means of a second of said ends of said curved rod.

5. A ski binding according to claim 1, wherein:

said support plate is a unitary element journalled about said longitudinal axis; and said arrangement for blocking said support plate comprises a blocking structure.

6. A ski binding according to claim 5, wherein:

said blocking structure is formed by at least one rib located beneath a part of said support plate.

7. A ski binding according to claim 1, wherein:

said support device comprises a fixed portion and a movable portion, said one lateral end portion of said support plate constituting said movable portion; and both said fixed portion and said movable portion have support surfaces in substantially horizontal alignment in said nominal position of said support plate.

8. A ski binding according to claim 6, wherein:

said substantially longitudinal fixed axis is offset with respect to a median longitudinal axis of the binding.

9. A ski binding according to claim 6, wherein:

said substantially longitudinal fixed axis is offset along a lateral edge of said support plate.

10. A ski binding according to claim 7, wherein:

said substantially longitudinal fixed axis is offset with respect to a median longitudinal axis of the binding.

11. A ski binding according to claim 1, wherein:

said one lateral end portion of said support plate is comprised of a portion of said support plate located on a predetermined lateral side of the binding; and one of said lateral retention wings of two lateral retention wings of said jaw being located at said predetermined lateral side of the binding; and said one lateral retention wing having a length shorter than a length of a second of said two lateral retention wings.

12. A binding for retaining a boot on an alpine ski, said binding comprising:

a base for attachment to a ski;

a body mounted on said base;

a retention jaw borne by said body, said retention jaw comprising two lateral retention wings for laterally retaining the boot, at least one of said lateral retention wings being mounted for a horizontal component of movement during a boot release movement;

a spring housed in said body for elastically opposing release movements of said jaw in response to forces transmitted by the boot;

a support device comprising a support plate for supporting at least an end of a sole of the boot, said support plate having a support surface for the boot that is substantially horizontal in a nominal position, said support plate further comprising oppositely disposed lateral end portions;

an arrangement for mounting said portion of said support plate for pivotal movement about a substantially longitudinal fixed axis relative to the ski between said nominal position and an inclined position with one lateral end portion of said support plate pivoted downwardly toward the ski, and for blocking downward pivotal movement of an opposite lateral end portion of said support plate from said nominal position; and a mechanism for reducing the force required to facilitate said boot release movement, said mechanism comprising a connecting member between said boot support plate and a portion of said binding, said connecting member being operable to facilitate said boot release movement in response to said one lateral end portion of said support plate being pivoted to said inclined position.

13. A ski binding according to claim 12, wherein:

an elastic return element is located beneath said one lateral end portion of said support plate for resisting said pivotal movement in said predetermined direction and for returning said support plate to said nominal position.

14. A ski binding according to claim 12, wherein:

a block of elastically deformable material is located beneath said opposite lateral end portion of said support plate for resisting said pivotal movement in said predetermined direction.

15. A ski binding according to claim 12, wherein:

a curved rod is located beneath said one portion of said support plate, said one lateral end portion of said support plate being supported by a median portion of said curved rod, said curved rod having a pair of ends, one of said ends is supported at a fixed abutment; and said mechanism comprises a compensation mechanism including a movable element for transmitting a force exerted by said one lateral end portion of said support plate by means of a second of said ends of said curved rod.

16. A ski binding according to claim 12, wherein:

said support plate is a unitary element journalled about said longitudinal axis; and said arrangement for blocking said support plate comprises a blocking structure.

17. A ski binding according to claim 16, wherein:

said blocking structure is formed by at least one rib located beneath a part of said support plate.

18. A ski binding according to claim 12, wherein:

said support device comprises a fixed portion and a movable portion, said one lateral end portion of said support plate constituting said movable portion; and both said fixed portion and said movable portion have support surfaces in substantially horizontal alignment in said nominal position of said support plate.

19. A ski binding according to claim 17, wherein:

said substantially longitudinal fixed axis is offset with respect to a median longitudinal axis of the binding.

20. A ski binding according to claim 17, wherein:

said substantially longitudinal fixed axis is offset along a lateral edge of said support plate.

21. A ski binding according to claim 18, wherein:

said substantially longitudinal fixed axis is offset with respect to a median longitudinal axis of the binding.

22. A ski binding according to claim 12, wherein:

said one lateral end portion of said support plate is comprised of a portion of said support plate located on a predetermined lateral side of the binding; and one of said lateral retention wings of two lateral retention wings of said jaw being located at said predetermined lateral side of the binding; and said one lateral retention wing having a length shorter than a length of a second of said two lateral retention wings.

23. A binding for retaining a boot on a ski, said binding comprising:

a base for attachment to a ski;

a body mounted on said base;

a retention jaw supported by said body, said retention jaw comprising means for retaining the boot against lateral release and against vertical release from the binding, said retaining means comprising at least one member which engages the boot and is mounted for lateral movement against a force exerted by the boot;

a spring housed in said body arranged to elastically oppose said lateral movement of said at least one member of said retaining means;

a support device comprising a support plate that supports at least a portion of a sole of the boot, said support plate having a support surface for the boot that is substantially horizontal in a nominal position of said support plate;

a support assembly that defines a transverse pivotal movement of said support plate in a predetermined direction about a fixed longitudinal axis to enable pivotal movement of one lateral end portion of said support plate from said nominal position to an inclined position toward the ski, said assembly further comprising means for engagement with an opposite lateral end portion of said support plate for blocking transverse pivotal movement of said opposite lateral end portion of said support plate from said nominal position in a direction opposite to said predetermined direction a mechanism for reducing the force required to facilitate said boot release movement, said mechanism comprising a connecting member between said boot support plate and a portion of said binding, said connecting member being operable to facilitate said boot release movement in response to said one lateral end of said support plate being pivoted to said inclined position.

24. A ski binding according to claim 23, wherein:

said mechanism for reducing the force required to facilitate said boot release movement comprises a mechanism for disengageably retaining said retention jaw against said boot releasing lateral movement independent of said spring; and an operative connection between said support plate and said mechanism for disengaging said retention jaw and permitting said boot releasing lateral movement independent of said spring in response to said pivotal movement of said support plate.

25. A ski binding according to claim 23, wherein:

said mechanism for reducing the force required to facilitate said boot release movement comprises a compensation mechanism for reducing a return force exerted by said spring on at least one of said lateral retention wings in response to a force exerted by the boot.

* * * * *